US005810159A

United States Patent [19]

Dorpmund

[11] Patent Number: 5,810,159

[45] Date of Patent: Sep. 22, 1998

[54] LINK CONVEYOR ESPECIALLY FOR PAPER-MAKING MACHINES

[75] Inventor: Klaus Dieter Dorpmund, Stolberg, Germany

[73] Assignee: Thomas Josef Heimbach GmbH & Co., Germany

[21] Appl. No.: 714,554

[22] Filed: Sep. 16, 1996

[30] Foreign Application Priority Data

Sep. 16, 1995 [DE] Germany ..... 195 34 486.3

[51] Int. Cl.[6] ..... B65G 17/06

[52] U.S. Cl. ..... 198/850; 198/851

[58] Field of Search ..... 198/850, 851, 198/852, 853

[56] References Cited

U.S. PATENT DOCUMENTS

| | | | |
|---|---|---|---|
| 865,591 | 9/1907 | Horst | 198/850 X |
| 4,381,612 | 5/1983 | Shank | 198/853 X |
| 4,395,308 | 7/1983 | Dawes | 162/232 |
| 4,469,221 | 9/1984 | Albert | 198/851 |
| 4,531,631 | 7/1985 | Klefisch | 198/853 |
| 4,564,551 | 1/1986 | Best | 428/222 |
| 4,796,749 | 1/1989 | Lefferts | 198/851 |
| 5,558,204 | 9/1996 | Daringer | 198/851 X |

FOREIGN PATENT DOCUMENTS

| | | | |
|---|---|---|---|
| 0050374 | 4/1982 | European Pat. Off. . | |
| 0112432 | 7/1984 | European Pat. Off. . | |
| 0128496 | 12/1984 | European Pat. Off. . | |
| 0171891 | 2/1986 | European Pat. Off. . | |
| 0211471 | 2/1987 | European Pat. Off. . | |
| 0292700 | 11/1988 | European Pat. Off. . | |
| 0472072 | 2/1992 | European Pat. Off. . | |
| 2419751 | 12/1975 | Germany . | |
| 2719548 | 11/1978 | Germany | 198/853 |
| 43430 | 11/1926 | Norway | 198/850 |
| 0610273 | 4/1979 | Switzerland | 198/853 |

*Primary Examiner*—James R. Bidwell
*Attorney, Agent, or Firm*—Joseph W. Berenato, III

[57] ABSTRACT

A link conveyor (1, 11), in particular, for paper-making machines, has hinged wires (2, 12) that extend in the lateral direction and link elements (3, 13) that extend in the longitudinal direction and that in each case enclose at least two hinged wires (2, 12), while link elements (3, 13) are shifted over the widths of the link conveyor (1, 11), in the longitudinal direction, by at least one hinged wire (2, 12). According to the invention, the link elements are made as ring elements (3, 13) with one single ring opening (4, 14) that will enclose at least two adjacent hinged wires (2, 12).

26 Claims, 2 Drawing Sheets

LINK CONVEYOR ESPECIALLY FOR PAPER-MAKING MACHINES

Figure 1:
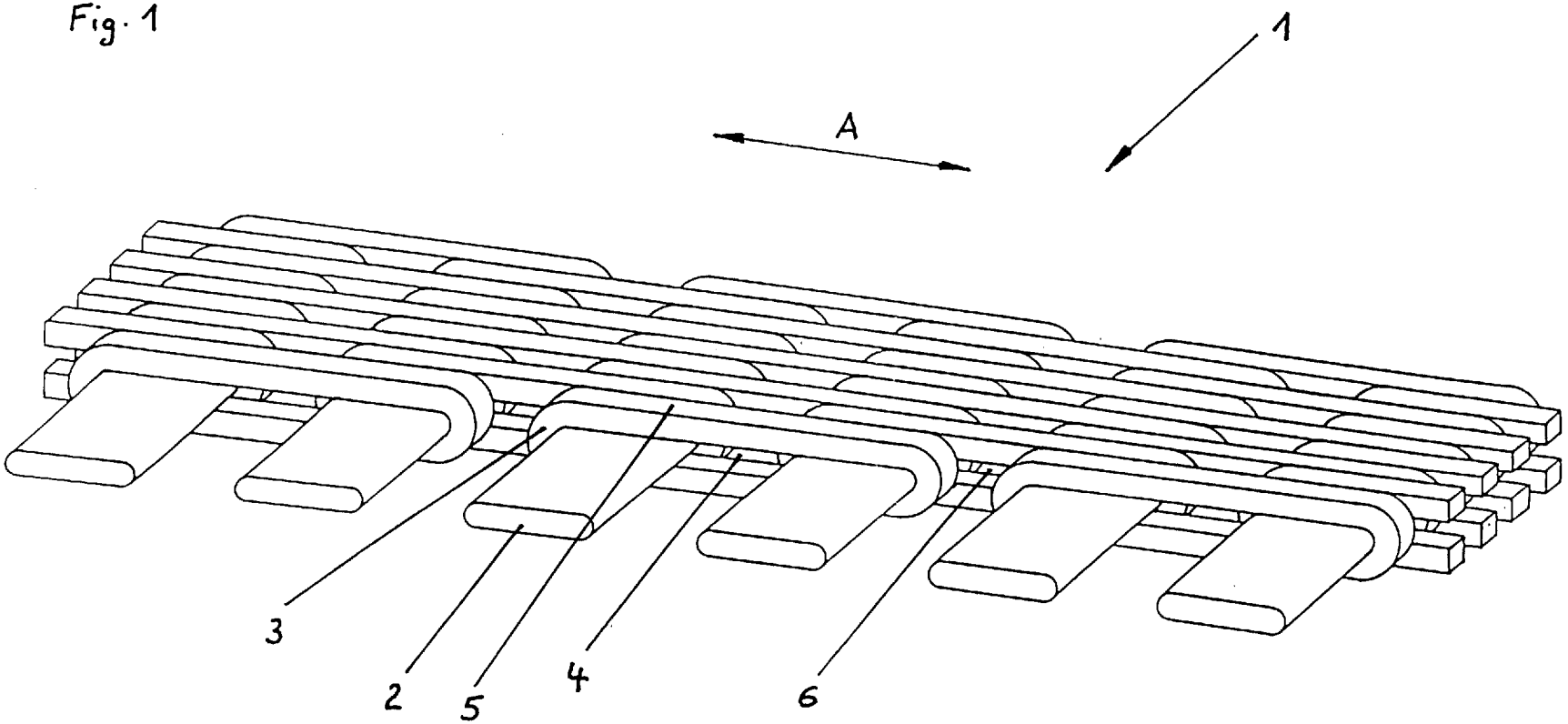

This invention relates to a link conveyor, especially for paper-making machines, with hinged wires that extend in the lateral direction and with link elements that extend in the longitudinal direction and that enclose at least two, each, neighboring hinged wires, with the link elements being shifted over the width of the link conveyor, in the longitudinal direction, by at least one hinged wire.

Such a link conveyor is disclosed in U.S. Pat. No. 4,469,221. It has a plurality of laterally extending hinged wires that have a circular cross-section and that are connected via link elements. A plurality of differently shaped link elements is shown here and all of them have passage openings at their ends to receive two, each, adjoining hinged wires. The passage openings are slit so that the passage openings can be widened. This makes it possible to allow the link elements to snap together with the hinged wires by means of a motion perpendicularly to their longitudinal axes. Therefore, one can also exchange individual link elements within one and the same complete link conveyor.

Only limited stability in the direction of traction can be achieved in this link conveyor on account of the slit openings. There is a danger that the passage openings may be widened and the arches of the link elements that limit the passage openings may break. This can spread like a crack so that even damage to individual link elements can lead to the complete rupture of the link conveyor. It is furthermore disadvantageous that air permeability cannot be essentially influenced. But it is precisely air permeability that is an essential property in the area in which a link conveyor is used for the most part, that is to say, in the dry portion of a paper making machine; this is why it must be possible to adjust the air permeability to an optimum value.

Also known are so-called wire link conveyors, such as can be found, for example, in U.S. Pat. No. 4,395,308, EP-A-0 050 374, EP-A-0 128 496, EP-B-0 292 700, EP-A-0 112 432, EP-A-0 472 072, EP-A-0 171 891, EP-B-0 211 471, and DE-A-24 19 751. Such wire link conveyors also have a plurality of hinged wires extending in the lateral direction, with the hinged wires having not only circular, but also flat oval or rectangular or bone-shaped cross sections. The hinged wires are connected in the case of wire link conveyors by wire spirals that, in each case, grasp two adjoining hinged wires and that extend progressively in a spiral fashion in the direction of the hinged wires. In the process, they engage particular adjoining wire spirals.

In the case of these wire link conveyors, it is possible to install filler elements in the space surrounding the wire spirals, in order thus specifically to reduce the air permeability which is generally too great (cf., EP-A-0 050 374, EP-B-0 292 700, EP-A-0 128 496, DE-A-24 19 751). A disadvantage in the case of wire link conveyors is represented by the fact that they are not simple to make. The wire spirals are made by means of plastic deformation with exposure to heat so that only thermoplasts can be used for this purpose. Besides, left-hand and right-hand spiraling wire spirals must be kept ready and must be connected in the proper order so that they will engage each other. It is also disadvantageous that the damage to one wire spiral can lead to the damage of the entire wire link conveyor being torn.

The object of the invention is so to design a link conveyor of the kind mentioned initially that it will be particularly traction-resistant, that the air permeability can be adjusted, and that it can be manufactured in a simple manner using materials that are not thermoplastic.

This problem is solved according to the invention in that the link elements are made as ring elements with one single ring opening in each case that will enclose at least two adjoining hinged wires.

The basic idea behind the invention is to use ring elements as link elements that can be pushed behind each other upon the hinged wires and that in each case enclose at least two adjoining hinged wires. Compared to the link elements of link conveyors of the kind involved and the wire spirals of wire link conveyors, the ring elements according to the invention offer a high degree of stability, especially in the direction of traction of the link belt. Damage to one of the link elements is not critical because the damage cannot be propagated. The ring openings of the ring elements furthermore make it possible to receive filler elements in order thus to adjust the air permeability of the link conveyor at a desired value. In addition, there is the fact that such link conveyors can be made in a very simple manner and that one is not confined to particular materials for certain parts of the link conveyor. It is therefore also possible to use duromers, where the ring elements can be made by punching up of a tape or by cutting correspondingly shaped pipes off. In this way, one can provide highly-resistant link conveyors at relatively low cost.

By way of a further development of the invention, it is provided that the height of the ring openings is constant over their extent in the longitudinal direction, so that the height of the ring openings should correspond to the height of the hinged wires. But other to designs of ring openings are also conceivable.

It is furthermore proposed that the ring elements have a straight, preferably flat surface on top and/or underneath. Deviating from that, it is possible to make the surface also convex or concave in order to achieve better adaptation to the particular conditions.

Basically, all possible cross-sections can be considered for the ring elements, for example, round or oval cross-sections. But it may also be practical to give the ring elements a square or rectangular cross-section, in particular, if one wants a flat surface.

The hinged wires can have a circular cross-section in the known manner. In this cross-section shape, the hinging capacity, and thus the divertability of the link conveyor, is particularly pronounced. But it is also possible to make the hinged wires oval or as flat wires (see all U.S. Pat. No. 4,395,308), so that their flat sides will extend parallel to the plane of the conveyor belt. Such hinged wires improve the traction-strength of the link conveyor or, in case of identical, constant traction resistance, it is possible to make particularly flat link conveyors. The air permeability can also be influenced in the desired manner by setting the height-width ratio. It is recommended that the hinged wires be rounded on the front regardless of their cross-section to support the hinging function.

In this particular link conveyor, one can also make provision to the effect that the support of the ring elements on the hinge wires is so made that the ring elements will be swung around the hinge axes that are shifted with respect to the mid-plane of the link conveyor. This design, known in the case of wire link conveyors (EP-B-0 472 072, which will be made reference to as to its full content) offers the advantage that the actual hinge axis, in the direction of the contact surface, is shifted between the track to be transported and the link conveyor and that the relative motion between the link conveyor and the track is reduced as the ring elements are swung.

According to the invention, it is also provided that the particular adjoining ring elements are shifted with respect to each other by one hinged wire. In this way, one gets a particularly uniform structure of the link conveyor.

By way of a further development of the invention, it is proposed that the ring elements have broadened segments on one or both flat sides of the link conveyor, where the segments preferably extend in the longitudinal direction up to a point close to the hinged wire that is enclosed by the particular pertinent ring element. Such widened segments are known in connection with wire link conveyors from EP-A-0 112 432, EP-A-0 171 891 and EP-B 0 211 471. With the help of these widened segments, one can adjust the air permeability of the link conveyor to a desired degree, something that is useful particularly for use from the dry portion of a paper making machine [sic]. Besides, this way one can enlarge the supporting surface for the paper track, specifically, in particular, if the segments of laterally adjacent ring elements are so wide that they form an essentially compact surface in the area of the segments.

The link conveyor according to the invention can also have a layer on at least one of the flat sides, for example, a fiber layer, a fabric, a knitted material, a folded material and/or a foil, as is known in connection with wire link conveyors particularly in combination with the above-described widened segments (cf, EP-A-0 171 891, EP-B-0 211 471). In this way, one can adapt the surface conformation of the link conveyor in accordance with particular requirements. In the process, one can also consider a combination of such layers, for example, a fabric or a knitted material with a fiber layer pinned on.

According to the invention, it is further provided that the hinged wires are made up of one or several monofilaments, multifilaments, and/or yarns embedded in a casing, such as this, has already been proposed in connection with wire link conveyors (cf, EP-B-0 292 700, to which reference will be made in full).

The ring elements can be made of whole plastics, so that the plastic material used can be adapted to the particular requirements corresponding to its properties. In case of higher requirements, particularly as regards mechanical strength, one can also consider ring elements that are made of a plastic provided with a reinforcement. The reinforcement can consist of fibers, threads, knitted material, fabrics, and/or folded threads.

In the simplest embodiment, the ring elements enclose two, each, adjoining hinged wires. But it is also possible to have the ring elements enclose three or more successive hinged wires so that, by correspondingly staggering the ring elements, one can keep the interval of the hinge bars constant also in this particular design.

The invention is explained in greater detail in the drawing with the help of an exemplary embodiment.

Figure 2:
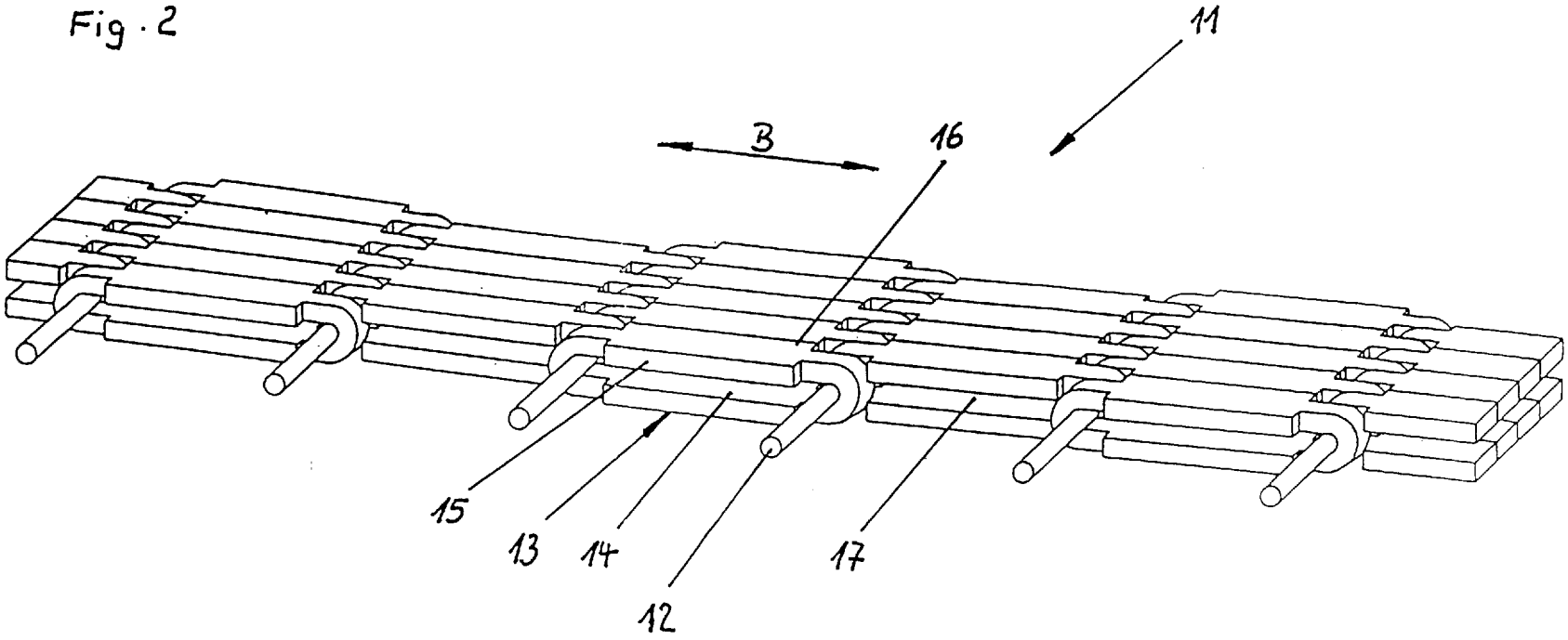

FIG. 1 shows a portion of a first link conveyor according to the invention in a prospective view; and FIG. 2 shows a portion of a second link conveyor according to the invention in a prospective view.

In the link conveyor shown in FIG. 1, the longitudinal extent and thus also the provided running direction of the link conveyor 1 is symbolized by the double arrow A. In this direction, link conveyor 1 forms a compact endless belt.

Link conveyor 1 has a plurality of hinged wires that extend in the lateral direction and that are labeled, by way of example, with the number 2. The hinged wires have a flattened cross section that is very wide and, in contrast to that, they have a low height, with a width-height ratio of about 5:1. Hinged wires 2 are level on top and underneath and are rounded in a semicircular fashion along the front and rear sides looking in the direction of movement. They are in each case at equal intervals from each other.

Two adjoining hinged wires 2, each time, are enclosed by a ring element, labeled 3, by way of example, together in a single opening, labeled 4. Ring elements 3 are adapted to the shape of hinged wires 2 in such a way that ring openings 4 will be oval and will throughout have a height that corresponds to the height of the hinged wires 2. On the front and rear edges, looking in the direction of motion, the ring elements are bent in a semicircular fashion so as to adapt to the rounded portions of hinged wires 2.

Ring elements 3 in this embodiment have a square cross section and extend straight, both on top and underneath. In this way, one can form planer surfaces, labeled 5, by way of example.

Two adjoining ring elements 3, in each case, are arranged around a hinged wire 2, in a manner shifted longitudinally with respect to each other. This means that a first ring element 3 will enclose two specific hinged wires 2, while the two adjoining ring elements 3 are so staggered that the first ring element of the two above-mentioned hinged wires 2 will enclose only one and, additionally, the hinged wire 2 that follows next in the longitudinal direction of the other ring element 3 that lies behind it in the longitudinal direction of the two above-mentioned hinged wires 2, will enclose only the other and, additionally, the hinged wire 2 that adjoins on the other side. This pattern is continued in a steady sequence so that two adjoining hinged wires 2, looking in the lateral direction of link conveyor 1, will be enclosed, together, only by every other ring element 3.

In the above-described pattern, ring elements 3 can be pushed upon hinged wires 2 in a simple manner. This process can also be mechanized so that one can make big link conveyors 1 in a simple and fast fashion, such as these link conveyors are needed, for example, in the dry portion of paper making machines. In the process, ring elements 3, between hinged wires 2, enclose ducts 6 that extend in the lateral direction over the entire width of link conveyor 1 into which one can insert filler elements such as can be found, for example, in EP-A-0 050 374 or EP-A-0 128 496. In this way, one can reduce the air permeability of the link conveyor to a desired value.

Link conveyor 11, shown in FIG. 2, whose direction of movement is symbolized by double arrow B, also has a plurality of hinged wires that extend in the lateral direction and that are labeled 12, by way of example, and that, in this particular case, have a circular cross section. Two adjoining hinged wires 12, each, are enclosed by one ring element, labeled 13, by way of example. Ring elements 13 are so fashioned that an oval ring opening 14 is formed and it has the same height throughout, so that the height will correspond to the diameter of the hinged wires 12. On the front and rear ends, looking in the direction of movement, ring elements 13 are bent in a semicircular fashion so as to adapt to the hinged wires 12.

Ring elements 13 have a rectangular cross section and extend straight, both on top and underneath. In this straight sectors, ring elements 13 have widened segments—labeled 15 and 16, by way of example—that protrude toward both lateral sides on top and underneath; segments 15, 16, of laterally adjoining ring elements 13, are practically placed against each other so that, in the sector of these segments 15, 16, one gets an almost compact surface.

As for the rest, the arrangement of ring elements 13 with respect to each other corresponds to the embodiment shown in FIG. 1, that is to say, in the area of hinged wires 13, a first ring element 13 that encloses two specific hinged wires 12, will, in each case, alternate with an adjacent ring element 13 which is shifted by one hinged wire 13 in the longitudinal direction (arrow B). In this way, two adjacent hinged wires 12—looking in the lateral direction of link conveyor 11—will be enclosed together only by every other ring element 13.

In this link conveyor 11, likewise, ducts 17 are formed and extend laterally over the entire width. Naturally, one can also insert into these ducts 17 filler elements such as they are known, from EP-A-0 050 374, EP-A-0 128 496, DE-A-24 19 751, and EP-B-0 292 700. As a rule, however, because of the presence of segments 15, 16, one can get along without such filler elements in this particular embodiment.

What is claimed:

1. Link conveyor for paper-making machines with hinged wires extending in the lateral direction and with at least two, each, link elements that extend in the longitudinal direction and that enclose at least two hinged wires, with the link elements being staggered over the width of the link conveyor in the longitudinal direction by at least one hinged wire, wherein the link elements are made as integrally closed ring elements having a flat surface on top with one single ring opening in each case, said ring elements enclosing at least two neighboring hinged wires and said hinged wires extending uninterruptedly across the conveyor.

2. Link conveyor according to claim 1, above, wherein the height of the ring openings in each case is constant in terms of their extent in the longitudinal direction.

3. Link conveyor according to claim 2, above, wherein the height of the ring openings corresponds to the height of the hinged wires.

4. Link conveyor according to claim 1, above, wherein the ring elements have a flat surface on the bottom.

5. Link conveyor according to claim 4, above, wherein the ring elements have a level surface on at least one of the top and the bottom surfaces.

6. Link conveyor according to claim 1, above, wherein the ring elements have a square or rectangular cross section.

7. Link conveyor according to claim 1, above, wherein the hinged wires have a circular or oval cross section.

8. Link conveyor according to claim 1, above, wherein the hinged wires are made as flat wires whose flat sides extend parallel to the plane of the belt.

9. Link conveyor according to claim 1, above, wherein the hinged wires are rounded on the front.

10. Link conveyor according to claim 1, above, wherein the support of the ring elements on the hinged wires is so made that the ring elements will swing around the hinge axes that are shifted with respect to the mid-plane of the link conveyor.

11. Link conveyor according to claim 1, above, wherein the particular neighboring ring elements are shifted with respect to each other by one hinged wire in the longitudinal direction of the belt.

12. Link conveyor according to claim 1, above, wherein the ring elements have broadened segments on one or both flat sides of the link conveyor.

13. Link conveyor according to claim 12, above, wherein the broadened segments extend in the longitudinal direction all the way to a point close to the hinged wires that are enclosed by the particular pertinent ring elements.

14. Link conveyor according to claim 12, above, wherein the broadened segments of laterally adjoining ring elements are so wide that they will form an essentially compact surface in the area of the broadened segments.

15. Link conveyor according to claim 1, above, wherein the link conveyor has a layer on at least one flat side.

16. Link conveyor according to claim 15, above, wherein the layer is selected from the group consisting of a fiber layer, fabric, knitted material, folding material, and foil.

17. Link conveyor according to claim 1, above, wherein the hinged wires are selected from the group consisting of monoflaments, multifilaments, and yam embedded in a casing.

18. Link conveyor according to claim 1, above, wherein the ring elements consist of a plastic substance provided with reinforcement.

19. Link conveyor according to claim 18, above, wherein the reinforcement is selected from the group consisting of fibers, threads, knitted materials, fabrics, and folded yams.

20. Link conveyor according to claim 13, wherein the broadened segments of laterally adjoining ring elements are so wide that they will form an essentially compact surface in the area of the broadened segments.

21. A link conveyor for paper-making machines, comprising;

a) a plurality of link elements arrayed in first and second sets, each link element being ring-shaped with a flat top surface and having an integrally closed elongated opening;

b) a plurality of adjacent uninterrupted parallel hinged wires extending in a first lateral direction;

c) the link elements of said first set alternated in said first lateral direction with cooperating link elements of said second set and overlap therewith in a second transverse longitudinal direction; and d) each of said hinged wires extends through the opening of adjacently disposed cooperating link elements of said first and second sets.

22. The link conveyor of claim 21, wherein;

a) said link elements have a flat bottom surface.

23. The link conveyor of claim 21, wherein;

a) said hinged wires include first and second flat sides extending parallel to the plane of the belt.

24. The link conveyor of claim 21, wherein;

a) said hinged wires have an oval cross section.

25. The link conveyor of claim 22, wherein;

a) said link elements include first and second broadened segments extending in the longitudinal direction on said top and bottom surfaces.

26. The link conveyor of claim 25, wherein;

a) said broadened segments of laterally adjacent link elements are adjoining.

* * * * *